US007289755B2

(12) United States Patent
Terai

(10) Patent No.: US 7,289,755 B2
(45) Date of Patent: Oct. 30, 2007

(54) DEVELOPMENT APPARATUS, PROCESS CARTRIDGE, AND IMAGE FORMING APPARATUS

(75) Inventor: Junichi Terai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 85 days.

(21) Appl. No.: 11/040,003

(22) Filed: Jan. 24, 2005

(65) Prior Publication Data

US 2005/0185974 A1 Aug. 25, 2005

(30) Foreign Application Priority Data

Jan. 27, 2004 (JP) ..... 2004-018534

(51) Int. Cl.
*G03G 15/09* (2006.01)

(52) U.S. Cl. ..... 399/274; 399/267

(58) Field of Classification Search ..... 324/274, 324/267, 265, 252, 222, 130, 275–277; 399/274, 399/267, 265, 252, 222, 130, 275, 276, 277
See application file for complete search history.

(56) References Cited

U.S. PATENT DOCUMENTS

| | | | | |
|---|---|---|---|---|
| 4,373,798 | A * | 2/1983 | Tsukada et al. | 399/267 |
| 4,377,332 | A * | 3/1983 | Tamura | 399/275 |
| 4,430,411 | A * | 2/1984 | Tamura et al. | 430/122 |
| 4,625,676 | A * | 12/1986 | Sakamoto et al. | 399/274 |
| 5,051,760 | A | 9/1991 | Shoji et al. | |
| 5,072,690 | A * | 12/1991 | Ishikawa et al. | 399/275 |
| 5,848,326 | A | 12/1998 | Komuro et al. | |
| 5,897,246 | A * | 4/1999 | Yamashita | 399/267 |
| 5,920,754 | A * | 7/1999 | Chung et al. | 399/119 |
| 6,337,957 | B1 | 1/2002 | Tamaki et al. | |
| 6,522,855 | B1 | 2/2003 | Katoh et al. | |
| 6,681,092 | B2 | 1/2004 | Terai | |
| 6,757,510 | B2 | 6/2004 | Terai | |
| 2002/0141789 | A1 * | 10/2002 | Terai | 399/267 |
| 2003/0016964 | A1 | 1/2003 | Terai | |
| 2004/0114971 | A1 | 6/2004 | Sakai et al. | |

FOREIGN PATENT DOCUMENTS

| | | |
|---|---|---|
| JP | 62-116975 | 5/1987 |
| JP | 2-67354 | 5/1990 |
| JP | 3-160481 | 7/1991 |
| JP | 5-82942 | 11/1993 |
| JP | 7-1409 | 1/1995 |
| JP | 7-306587 | 11/1995 |
| JP | 9-6116 | 1/1997 |
| JP | 9-185261 | 7/1997 |
| JP | 3246986 | 11/2001 |

(Continued)

*Primary Examiner*—Vincent Q. Nguyen
*Assistant Examiner*—Hoai-An D. Nguyen
(74) *Attorney, Agent, or Firm*—Oblon, Spivak, McClelland, Maier & Neustadt, P.C.

(57) ABSTRACT

A development apparatus is provided and includes a developer support, a developer-controlling member, and a developer-residue controlling member. The developer support supports developer on the surface. The developer-controlling member controls the thickness of the developer on the developer support. The developer-residue controlling member is disposed facing the developer support immediately upstream of the developer-controlling member in the direction in which the developer is conveyed by the developer support. The development apparatus also has a space between the developer-residue controlling member and the developer support that decreases in size downstream in the direction in which the developer is conveyed.

9 Claims, 7 Drawing Sheets

FOREIGN PATENT DOCUMENTS

| | | |
|---|---|---|
| JP | 2002-229328 | 8/2002 |
| JP | 2002-244439 | 8/2002 |
| JP | 2002-278276 | 9/2002 |
| JP | 2002-287501 | 10/2002 |
| JP | 2002-351221 | 12/2002 |
| JP | 2003-84634 | 3/2003 |
| JP | 3449136 | 7/2003 |
| JP | 2003-255692 | 9/2003 |
| JP | 2003-295599 | 10/2003 |
| JP | 2004-191835 | 7/2004 |

* cited by examiner

DEVELOPMENT APPARATUS, PROCESS CARTRIDGE, AND IMAGE FORMING APPARATUS

BACKGROUND OF THE INVENTION

1. Field of the Invention

The present invention relates to a copy machine, a FAX machine, a printer, or another such image-forming apparatus, and particularly relates to a development apparatus provided thereto and a process cartridge including this development apparatus.

2. Description of the Background Art

Copy machines, FAX machines, printers, and other such image-forming apparatuses generally include development apparatuses that use a developer to develop an electrostatic latent image formed on a photo conductor or another such image support. Such development apparatuses include a developer support that supports a developer on the surface thereof in order to supply the developer to the image support, and a developer-controlling member that supplies an appropriate amount of the developer to the image support by the developer support, that is disposed next to the developer support with a space in between, and that controls the thickness of the developer on the developer support. Development apparatuses with such a configuration are disclosed in Japanese Laid-Open Patent Application Nos. 9-6116, 9-185261, 9-204100, 2002-229328, and the like.

However, since such a developer-controlling member is designed to scrape up the developer temporarily supported on the developer support to control the thickness of the developer on the developer support, the scraped developer remains in the development apparatus and forms a residual developer layer, or, specifically, a residual layer. In view of this, Japanese Laid-Open Patent Application No. 2002-229328, for example, proposes a development apparatus that has a developer-residue controlling member disposed facing a developer support immediately upstream of a developer-controlling member in the direction in which the developer is conveyed by the developer support in order to prevent this residual layer from forming.

However, a development apparatus with such a developer-residue controlling member is subject to problems with nonuniform image concentration.

SUMMARY OF THE INVENTION

An object of the present invention is to provide a development apparatus that has a developer-residue controlling member for preventing a developer residue from being formed by a developer-controlling member and that is not subject to image concentration irregularities, to provide a process cartridge that has this development apparatus, and to provide a copy machine, FAX machine, printer, or another such image-forming apparatus that has this development apparatus or process cartridge.

A development apparatus of the invention comprises a developer support that supports developer on the surface; a developer-controlling member that controls the thickness of the developer on the developer support; a developer-residue controlling member disposed facing the developer support immediately upstream of the developer-controlling member in the direction in which the developer is conveyed by the developer support; and a space between the developer-residue controlling member and the developer support that decreases in size downstream in the direction in which the developer is conveyed.

A process cartridge detachably mounted on the main body of an image-forming apparatus of the present invention comprises a development apparatus; and at least one component integrated with the development apparatus and selected from among an image support, electrical charging means for charging the image support, and cleaning means for cleaning the image support. The development apparatus comprises a developer support that supports developer on the surface; a developer-controlling member that controls the thickness of the developer on the developer support; a developer-residue controlling member disposed facing the developer support immediately upstream of the developer-controlling member in the direction in which the developer is conveyed by the developer support; and a space between the developer-residue controlling member and the developer support that decreases in size downstream in the direction in which the developer is conveyed.

An image-forming apparatus of the present invention comprises a development apparatus. The development apparatus comprises a developer support that supports developer on the surface; a developer-controlling member that controls the thickness of the developer on the developer support; a developer-residue controlling member disposed facing the developer support immediately upstream of the developer-controlling member in the direction in which the developer is conveyed by the developer support; and a space between the developer-residue controlling member and the developer support that decreases in size downstream in the direction in which the developer is conveyed.

An image-forming apparatus of the present invention comprises a process cartridge. The process cartridge is detachably mounted on the main body of an image-forming apparatus and comprises a development apparatus; and at least one component integrated with the development apparatus and selected from among an image support, electrical charging means for charging the image support, and cleaning means for cleaning the image support. The development apparatus comprises a developer support that supports developer on the surface; a developer-controlling member that controls the thickness of the developer on the developer support; a developer-residue controlling member disposed facing the developer support immediately upstream of the developer-controlling member in the direction in which the developer is conveyed by the developer support; and a space between the developer-residue controlling member and the developer support that decreases in size downstream in the direction in which the developer is conveyed.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENTS

The conventional art and the problems thereof will be described prior to describing the present invention.

Figure 1:
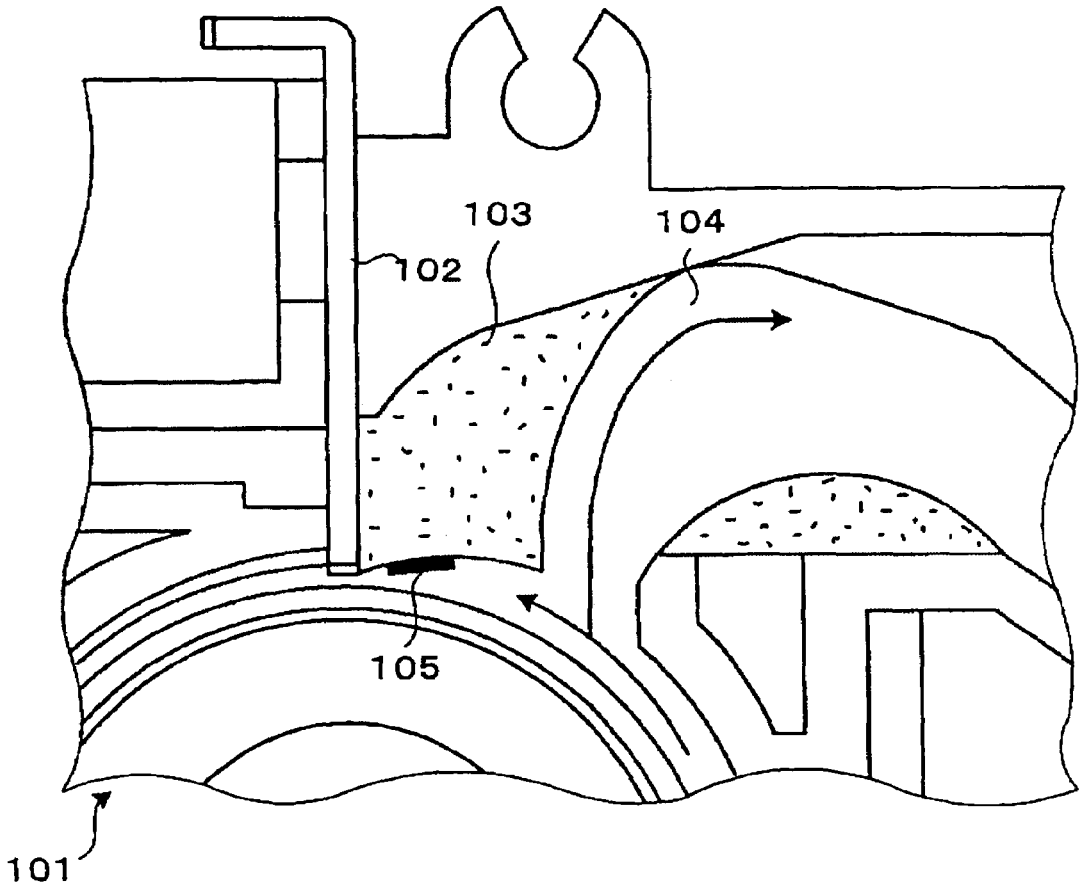
FIG. 1 PRIOR ART
FIG. 1 is a front view showing the interior of a conventional development apparatus in which the developer has remained and toner has bonded to the remaining developer.

FIG. 1 shows part of the configuration of a conventional development apparatus used in an image-forming apparatus. This development apparatus is provided with a developer-controlling member 102 that is disposed next to a developer support 101 with a space in between, and that controls the thickness of the developer on the developer support 101.

Since this developer-controlling member 102 is designed to scrape up the developer temporarily supported on the developer support 101 to control the thickness of the developer on the developer support 101, the scraped developer remains and forms a residual developer layer, or, specifically, a residual layer 103. In the border between the residual layer 103 and a developer layer in which the developer flows, or, specifically, a moving layer 104, friction heat is generated by friction with the developer, the toner sometimes adheres to the residual layer 103 to form an adhered part 105, and the adhered part 105 grows when adhesion is considerable. At the position where the adhered part 105 forms, the flow of developer slows, toner concentration is reduced, and when black typeset images are developed, for example, problems are sometimes encountered with the occurrence of white striped images.

Figure 2A:
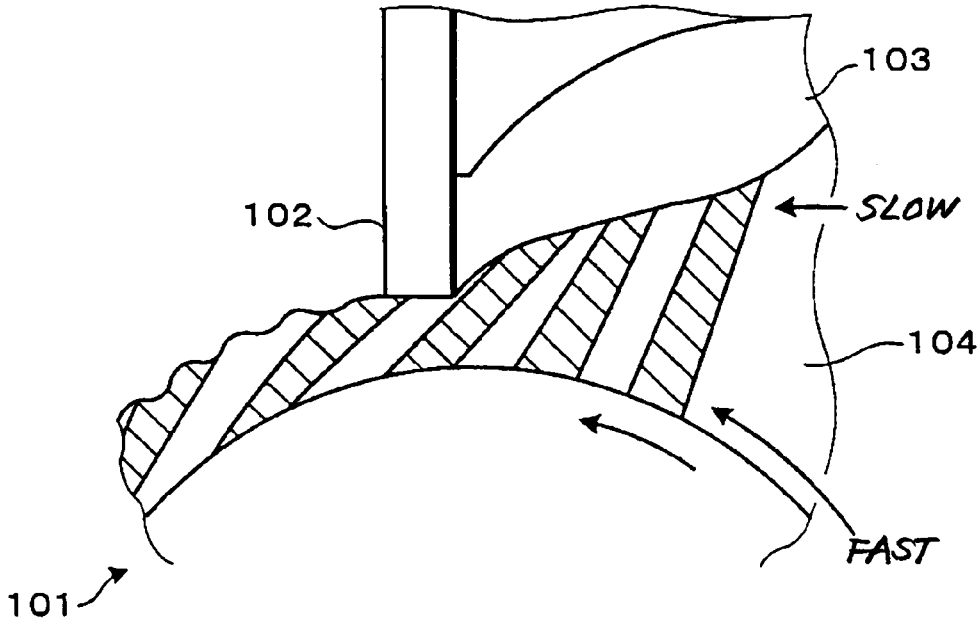
FIG. 2A PRIOR ART
FIGS. 2A and 2B are front views for describing the condition in a conventional development apparatus in which there are irregularities in toner concentration.
Figure 2B:
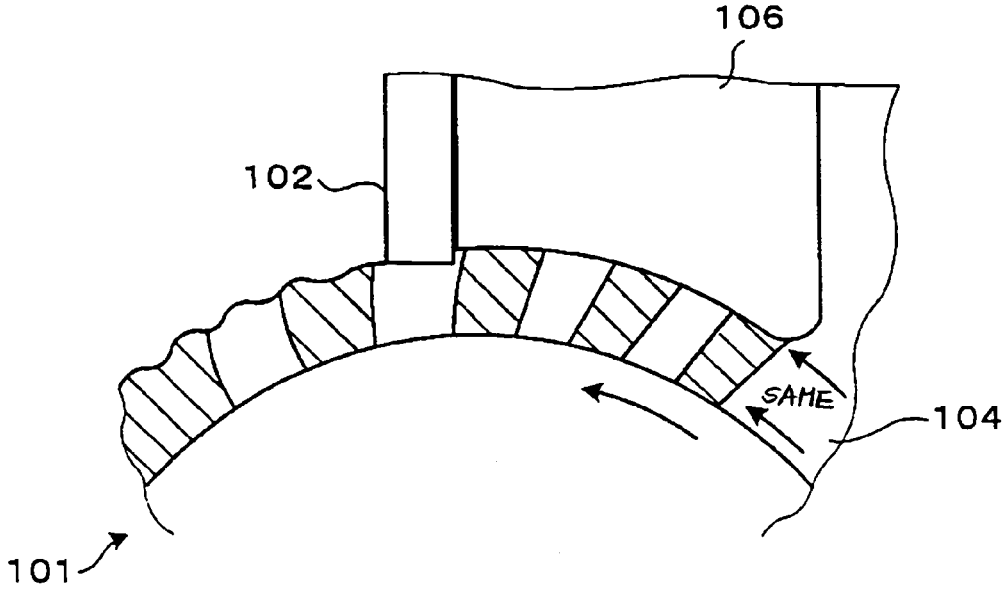
FIG. 2B PRIOR ART

In view of this, a development apparatus has been proposed that has a developer-residue controlling member 106 disposed facing a developer support immediately upstream of a developer-controlling member in the direction in which the developer is conveyed by the developer support, as shown in FIG. 2B, in order to prevent the residual layer from forming.

However, with a conventional development apparatus that has such a developer-residue controlling member 106, image concentration irregularities sometimes occur that were not observed in the development apparatus shown in FIG. 1. The image concentration irregularities are reductions wherein the concentration of typeset images or halftone images are nonuniform as a result of partial nonuniformity in the toner ratio, or, specifically, in the toner concentration, in a developer containing a toner and a carrier.

The inventor has contrived the following as a result of researching into the causes of image concentration irregularities. The state in which the developer is conveyed will now be described with reference to FIG. 8.

FIG. 2A shows the configuration of the development apparatus in FIG. 1, and FIG. 2B shows the configuration of a development apparatus that has a developer-residue controlling member. In FIGS. 2A and 2B, the developer is shown in a white and black striped pattern. In the white and black parts, the white parts show areas where the toner concentration is relatively low, and the black parts show areas where the toner concentration is relatively high.

In the development apparatus shown in FIG. 2A, the conveyed thickness of the developer decreases nearer to the developer-controlling member 102. The conveyance speed of the developer is approximately the same as the speed of the developer support 101 immediately above the developer support 101, while the conveyance speed of the developer away from the developer support 101 is lower due to friction with the residual layer 103. Therefore, the developer oriented in the shearing direction becomes misaligned in the thickness direction, and differences in the toner concentration are neutralized and eliminated. Therefore, image concentration irregularities do not occur.

By contrast, the development apparatus shown in FIG. 2B includes a developer-residue controlling member 106 that forms a space of a substantially constant size with the developer support 101 at a position facing the developer support 101, and the conveyance speed of the developer is therefore substantially constant in any area of the gap, there is no shearing of the developer in the thickness direction of the developer, and the toner concentration is not neutralized. As a result, problems are encountered in that differences in the toner concentration become evident as image concentration irregularities.

The present invention, in which the problems with the conventional art described above have been resolved, will now be described in detail with reference to the diagrams.

Figure 3:
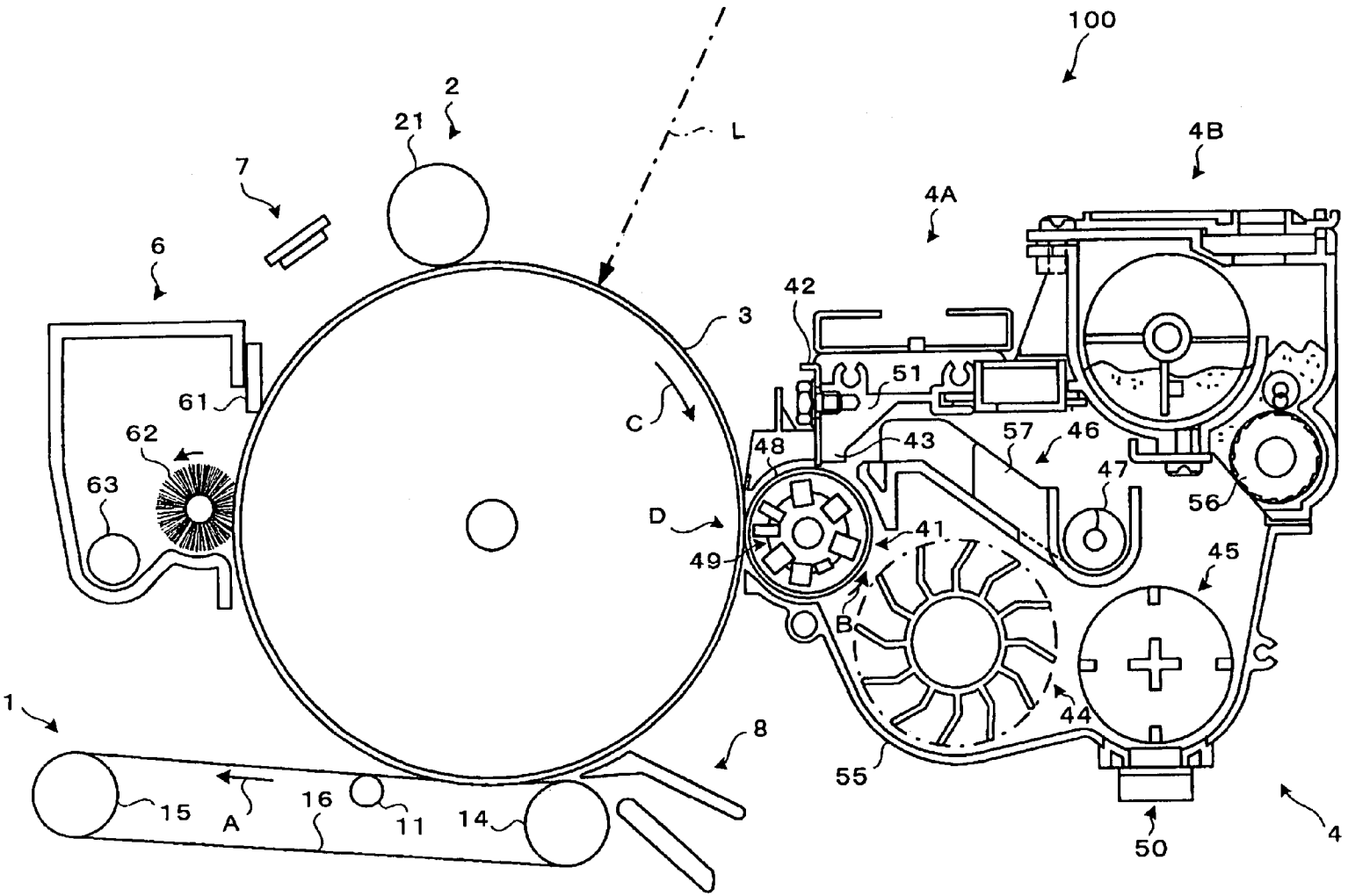
FIG. 3 is a front view showing the schematic configuration of a development apparatus and an image-forming apparatus to which the present invention is applied.

FIG. 3 shows the schematic configuration of an image-forming apparatus relating to one embodiment to which the present invention is applied. The image-forming apparatus 100 is a laser printer, but other types of printers, FAX machines, copy machines, compound machines with functions for both copying and printing, or any other such image-forming apparatus may be used. The image-forming apparatus in the present embodiment is one that forms monochromatic images, but one that forms color images may also be used. The image-forming apparatus 100 forms images on the basis of an image signal corresponding to image information received from external sources. This is the same as when the image-forming apparatus 100 is used as a FAX machine. The image-forming apparatus 100 can be used to form images on regular paper commonly used to make copies, as well as OHP sheets, cards, postcards, and other types of thick paper, as well as envelopes and any other such sheet-shaped material used as a recording medium.

The image-forming apparatus 100 has a photo conductor drum (hereinafter referred to as "photo conductor") 3 as a developer support formed into a cylinder that is rotatably driven in the direction of the arrow C, a charging apparatus 2 as a charging device that electrically charges the photo conductor 3, an exposure apparatus (not shown) as an exposure device that performs light scanning by emitting laser light L to form a latent image on the charged photo conductor 3 according to an image signal, and a development apparatus 4 as a development device that develops an electrostatic latent image on the photo conductor 3 after exposure.

The image-forming apparatus 100 also has a transfer and conveyance apparatus 1 that is disposed facing the photo conductor 3 underneath the photo conductor 3; that is a transfer device for transferring toner images on the photo conductor 3, which are obtained by performing development with the development apparatus 4, onto transfer paper, which is recording paper serving as a sheet-shaped recording medium; and that is also a conveyance apparatus for conveying toner images from the photo conductor 3 to the transfer paper. The image-forming device also has a cleaning apparatus 6, which is a cleaning unit serving as a cleaning device for cleaning the photo conductor 3 after the transfer; and a discharge apparatus 7 as a discharge device for discharging the electric charge in the photo conductor 3 before it is charged by the charging apparatus 2.

The image-forming apparatus 100 also has a paper feed tray (not shown) on which the transfer paper is stacked; a paper feed roller (not shown) as a paper feed device for sending the transfer paper stacked on the paper feed tray to the nip section, which is the section where the photo conductor 3 faces the transfer and conveyance apparatus 1; a resist roller (not shown) for conveying the transfer paper send from the paper feed tray by the paper feed roller to the nip section with specific timing; a guide member 8 for guiding the transfer paper sent by the resist roller towards the nip section; and a fixing apparatus (not shown) serving as a fixing device for fixing the toner images to the transfer paper onto which the toner images on the photo conductor 3 have been transferred by the transfer and conveyance apparatus 1.

The charging apparatus 2 has a charging roller 21 for driving the photo conductor 3 to rotate.

The cleaning apparatus 6 has a cleaning blade 61 and a cleaning brush 62 that rub against the photo conductor 3 to remove the toner remaining on the photo conductor 3 after the transfer, and also to remove paper dust and other impurities; and a conveying member 63 for conveying the impurities removed from the photo conductor 3 to the exterior of the cleaning apparatus 6.

The discharge apparatus 7 includes a discharge lamp (not shown). The discharge apparatus 7 is disposed at a position separated from the photo conductor 3 and is used to remove the electric potential remaining on the photo conductor 3 after the transfer.

The transfer and conveyance apparatus 1 has a driving roller 14, a driven roller 15, a transfer belt 16 wound around the driving roller 14 and driven roller 15 and rotatably driven in the direction shown by the arrow A, and a bias roller 11 as a transfer bias roller for printing a transfer bias onto the transfer belt 16. A simple roller-shape device, a transfer charger, or the like may be used as the transfer device.

Figure 4:
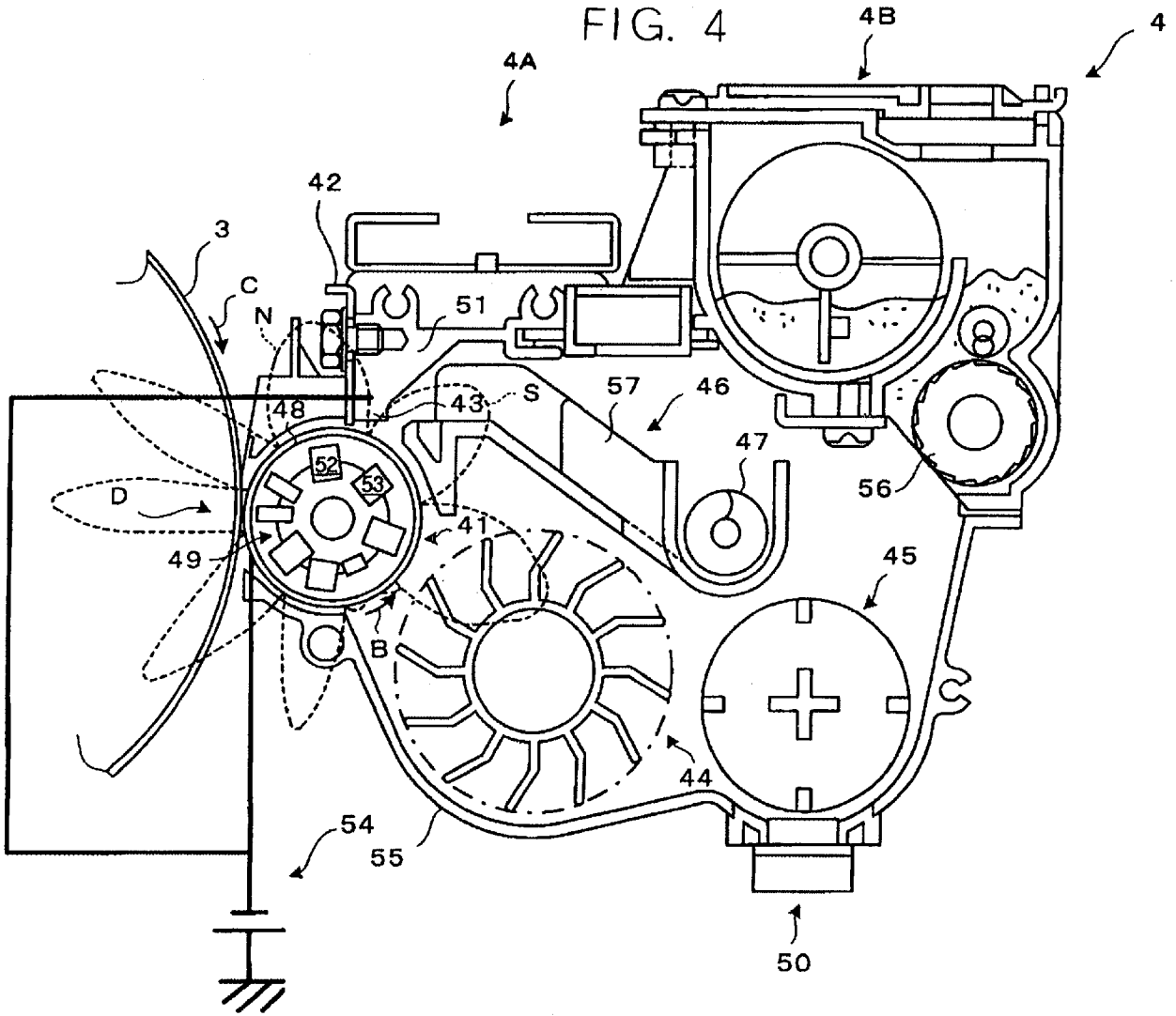
FIG. 4 is an enlarged front view showing the configuration of the development apparatus depicted in FIG. 3.

The development apparatus 4 has a development container 4A and a toner replenishing unit 4B, as shown in FIGS. 3 and 4. The development apparatus 4 has a development roller 41 that is disposed facing the photo conductor 3 in the development container 4A and that serves as a developer support that supports the developer on the surface thereof, a stay 51 as an integral structural support for the development container 4A, a doctor blade 42 supported by the stay 51 as a developer-controlling member that controls the thickness of the developer supported on the development roller 41, and a control member 43 that is configured by part of the stay 51 and serves as a developer-residue controlling member disposed facing the development roller 41.

In the development container 4A, the development apparatus 4 also has a paddle wheel 44 that is part of the development roller 41 and is disposed on the side opposite the photo conductor 3, a stirring roller 45 that is part of the paddle wheel 44 and is disposed on the side opposite the development roller 41, a separator 46 positioned above the paddle wheel 44, and a screw 47 for the separator 46 as a stirring screw disposed at the end toward the stirring roller 45.

In the development container 4A, the development apparatus 4 also has a development bias power circuit 54 as an electric potential setting means that has both a first electric potential setting device for setting the development roller 41 and the doctor blade 42 to the same electric potential, and a second electric potential setting device for setting the development roller 41 and the control member 43 to the same electric potential. The container also has a toner concentration sensor 50 disposed below the stirring roller 45.

The development container 4A has a developer case 55 as a developer-storing member disposed so as to enfold the development roller 41 and the paddle wheel 44 from below. The development apparatus 4 retains toner in the toner replenishing unit 4B. The development apparatus 4 has a toner-replenishing roller 56 in the toner replenishing unit 4B, and is designed to supply the retained toner into the development container 4A when the toner-replenishing roller 56 rotates. The area where the development roller 41 and the photo conductor 3 face each other constitutes a development area D where the toner in the developer supported on the development roller 41 moves onto the photo conductor 3 to perform development.

The development roller 41 has on the surface a development sleeve 48 that supports the developer and is made by forming aluminum into a cylinder, and a magnet roller 49 as a magnetic field generating device that is disposed in a fixed state in the development sleeve 48 and that forms a magnetic field on the surface of the development sleeve 48 so as to nap the developer.

The development sleeve 48 is rotatably driven by a rotational driving mechanism (not shown) in the counterclockwise direction shown in the diagram by the arrow B. The development sleeve 48 should be nonmagnetic and may be configured from aluminum, as well as brass, stainless steel, a conductive resin, or the like. The magnet roller 49 has a plurality of magnets that include magnets 52 and 53 integrated around the peripheral surface, and generates a line of magnetic force as shown by the dotted line in FIG. 4. The magnet 52 generates N-pole lines of magnetic force, and the magnet 53 generates S-pole lines of magnetic force.

Consequently, the carrier constituting the developer follows the line of magnetic force generated from the magnet roller 49 and is napped into a chain pattern on the development sleeve 48. The charged toner then adheres to the carrier napped into a chain pattern to form a magnetic brush. The magnetic brush thus formed moves in the same direction as the development sleeve 48 along with the rotation of the development sleeve 48, or, specifically, in the direction of the arrow B, which is counterclockwise.

The doctor blade 42 is disposed facing the development roller 41 at a position upstream of the development area D in the direction of the arrow B, and forms a space of 0.5 mm with the development sleeve 48. The doctor blade 42 controls the napping of the particles in the chain formed by the developer, or specifically the thickness of the developer, in other words, the amount of the developer. The doctor blade 42 is made of stainless steel, but can also be configured from aluminum or other such metal.

The control member 43 is disposed facing the development roller 41 in an adjacent position upstream, or, specifically, immediately upstream, of the doctor blade 42 in the direction of the arrow B, and forms a specific space described later that is larger than the space between the doctor blade 42 and the development sleeve 48. The purpose of this is to have a configuration wherein excess developer is controlled with the control member 43, and the layer thickness is ultimately controlled with the doctor blade 42.

In addition to controlling the amount of developer, the control member 43 also suppresses to a minimum the formation of the residual layer by the developer scraped up from the development sleeve 48 by the doctor blade 42, as previously described. The stay 51 integrated with the control member 43 is made of stainless steel, but can also be configured from aluminum, iron, or other such metals, or a conductive resin material in which carbon particles or the like are dispersed.

The development bias power circuit 54 is electrically connected to the development sleeve 48 and the stay 51, and provides the same electric potential. The stay 51 and the doctor blade 42 are electrically conductive and have the same electric potential. Consequently, the control member 43, the doctor blade 42 in the development sleeve 48, and the stay 51 have the same electric potential due to the development bias power circuit 54.

To describe the development bias of a common development apparatus, normally only the developer support is charged with a direct-current voltage or a direct-current voltage superposed with an alternating-current voltage as a development bias, and as a result, an electric potential difference is created between the developer support and the developer-controlling member or the developer-residue controlling member. Therefore, for example, the developer-controlling member or the developer-residue controlling member are grounded as metal or other such conductive materials, and a toner with negative electric characteristics is used to perform reverse development wherein a voltage of −500 V is applied as a development bias, whereupon the toner adheres to the developer-controlling member or the developer-residue controlling member and is bonded thereon due to the electric potential difference of 500 V, and the functions thereof are weakened. Also, for example, the developer-controlling member or the developer-residue controlling member are grounded as metal or other such conductive materials, and a toner with positive electric characteristics is used to perform normal development wherein a voltage of −300 V is applied as a development bias, whereupon the toner adheres to the developer support and is bonded thereon due to the electric potential difference of 300 V, the effective development bias fluctuates, and an abnormal image is created.

However, in the present embodiment, the toner is prevented from adhering to or being adsorbed on these members due to the development sleeve 48 and the control member 43 having the same electric potential, and the toner is also prevented from adhering to or being adsorbed on the doctor blade 42 due to the development sleeve 48 and the doctor blade 42 having the same electric potential. Since this adhesion and adsorption of toner is prevented, the bonding of developer resulting from mechanical stress or heating in a state of such adhesion and adsorption is prevented from forming a layer, and as a result, the space through which the developer can move is not reduced, and the amount of flowing developer does not decrease. Therefore, the thickness of the developer layer on the development sleeve 48 can be preserved and maintained in a stable manner, and satisfactory development can be ensured over time.

The stirring roller 45 stirs and mixes the developer. The paddle wheel 44 draws up the developer that has been stirred and mixed by the stirring roller 45 toward the development roller 41 while further stirring and mixing the developer. The toner concentration sensor 50 is designed to determine if the toner concentration in the developer has fallen below a specific concentration sufficient for developing the photo conductor 3, and when the toner concentration sensor 50 determines that the toner concentration in the developer has fallen below the specific concentration, the toner-replenishing roller 56 rotates, and the toner in the toner replenishing unit 4B is sent to the stirring roller 45 and is supplied into the development container 4A. The toner supplied to the development container 4A from the toner replenishing unit 4B is stirred and mixed with the developer in the development container 4A by the stirring roller 45.

The separator 46 extends so that one end is positioned near the control member 43 and the other end is positioned near the stirring roller 45, and is inclined so that the end near the stirring roller 45 faces downward. The separator 46 has a plurality of fins 57 aligned near the screw 47 in a direction perpendicular to the paper surface in FIGS. 3 and 4. The fins 57 are inclined so that the ends on the side of the screw 47 face into the paper surface in FIGS. 3 and 4.

The screw 47 is disposed at a section in the lowest position of the separator 46. The screw 47 rotates to convey the developer from the side in the paper surface in FIGS. 3 and 4 towards the viewer. Therefore, the developer controlled by the control member 43 and guided onto the separator 46 moves toward the paper surface in FIGS. 3 and 4 while slipping down from the main body of the separator 46 to the screw 47, and the developer that has fallen onto the screw 47 is conveyed towards the viewer from behind the paper surface in FIGS. 3 and 4 due to the rotation of the screw 47. The developer that has been conveyed by the screw 47 falls down to the stirring roller 45 and is stirred and mixed by the stirring roller 45. Thus, as a result of the developer being stirred in the development container 4A in a direction perpendicular to the paper surface in FIGS. 3 and 4, the amount of developer is made uniform in this direction while the toner concentration is made uniform in this direction.

In a development apparatus 4 with such a configuration, the developer stirred and mixed by the stirring roller 45 is drawn up by the rotation of the paddle wheel 44, propelled to the development roller 41, and supported on the surface of the development roller 41 by the magnetic force of the magnet roller 49. The developer supported on the development roller 41 moves over the surface along with the rotation of the development sleeve 48, the excess layer thickness is controlled at the distal end of the control member 43, and while the layer thickness is ultimately controlled by the doctor blade 42, the developer passes through the development area D in which the development roller 41 and the photo conductor 3 face each other. At this time, the toner in the developer moves toward the photo conductor 3 and is consumed by the developing of an electrostatic latent image on the photo conductor 3.

The development sleeve 48 continues to rotate and convey the developer, and the developer passes through the space between the development sleeve 48 and the developer case 55. The developer then falls to the bottom of the developer case 55 at a position where the magnetic force of the magnet roller 49 no longer has effect, and the developer is subsequently drawn again up to the development roller 41 while being stirred and mixed by the paddle wheel 44.

The excess developer scraped up by the control member 43 flows along the right side of the stay 51 in FIGS. 3 and 4, conveyed onto the separator 46, stirred and mixed by the separator 46 and the screw 47 in a direction perpendicular to the paper surface in FIGS. 3 and 4, and caused to fall down to the stirring roller 45.

As already described, if the space between the control member 43 and the surface of the development roller 41, or, specifically, the development sleeve 48, is of a substantially constant size as shown in FIG. 2B, then the speed at which the developer is conveyed is also substantially constant in any area of this space, there is no misalignment of the developer in the thickness direction of the developer, and the toner concentration is not neutralized. Therefore, differences in toner concentration, or, specifically, irregularities in toner concentration, are manifested as image concentration irregularities.

Figure 5:
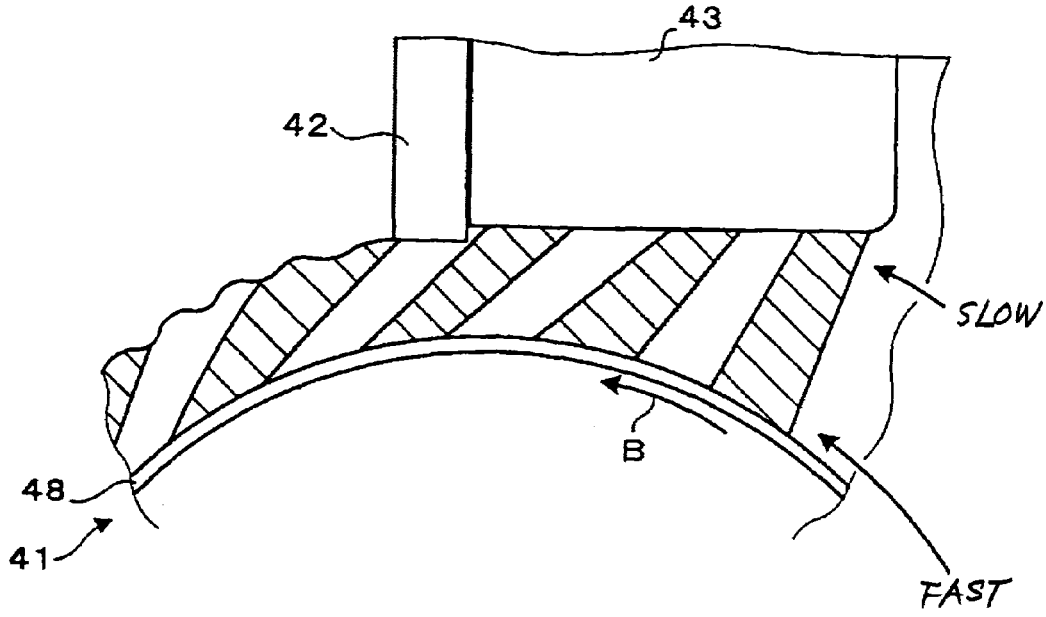
FIG. 5 is an enlarged front view showing the shape of the space formed between the developer-residue controlling member and the developer support provided to the development apparatus shown in FIGS. 3 and 4.

In view of this, in order to prevent such image concentration irregularities, the shape of the control member 43 in the present embodiment is designed such that the size of the space between the control member 43 and the development sleeve 48 decreases downstream in the direction of the arrow B, as shown in FIG. 5. In FIG. 5, the developer is shown in a white and black striped pattern, similar to FIGS. 2A and 2B. In the white and black parts, the white parts show areas where the toner concentration is relatively low, and the black parts show areas where the toner concentration is relatively high.

In the present embodiment, the shape of the control member 43 is as described above, and the size of the space between the control member 43 and the development sleeve 48 is as described above, which ensures that no image concentration irregularities will occur. The supposed reason for this is that the thickness by which the developer is conveyed decreases nearer to the doctor blade 42, the speed by which the developer is conveyed is greater immediately above the development sleeve 48 than away from the development sleeve 48, there are discrepancies in the tendency for the developer to be sheared in the thickness direction, and differences in toner concentration are neutralized and resolved.

Figure 6:
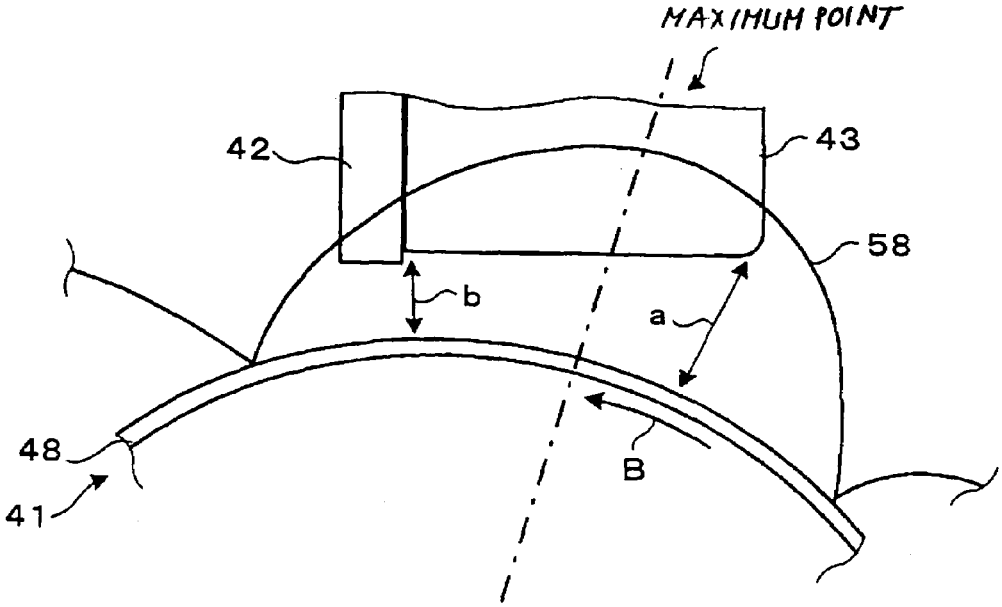
FIG. 6 is an enlarged front view showing the density of a magnetic flux formed by a magnetic field generating device provided to the development apparatus shown in FIGS. 3 and 4.

The size of the space between the development sleeve 48 and the control member 43 has a maximum value a at the position farthest upstream in the direction of the arrow B, and has a minimum value b at the position farthest downstream in the direction of the arrow B, as shown in FIG. 6. The maximum value a is preferably kept at 2.0 to 5.0 mm in order to effectively prevent a developer residue from forming. The minimum value b is preferably kept at 1.8 mm or less in order to more effectively prevent a developer residue from forming. The minimum value b is more preferably kept at 1.4 mm or less in order to effectively prevent a developer residue from forming when the development sleeve 48 rotates at its highest speed.

Also, the length of the surface of the control member 43 that faces the development sleeve 48 is set to 6.5 mm in order to effectively prevent a developer residue from forming. The control member 43 has a flat surface facing the development sleeve 48, whereby the size of the space formed with the development sleeve 48 gradually decreases evenly downstream in the direction of the arrow B, but the size of the space between the control member 43 and the development sleeve 48 may also gradually decrease as a whole downstream in the direction of the arrow B so that it narrows intermittently, for example.

It was learned that when the configuration is designed so that the space between the control member 43 and the development sleeve 48 decreases downstream in the direction of the arrow B, the conveyance of the developer meets with resistance because the gap has a wedge shape. In particular, the developer is blocked by this wedge-shaped space and is hardly conveyed at all when the toner concentration is high and the fluidity of the developer is reduced.

In view of this, the development apparatus 4 is configured such that the maximum point for the density of the magnetic flux that is formed by the magnet roller 49 and is parallel to the direction of the arrow B is located at the position where the control member 43 is disposed. Specifically, the configuration is such that the positions of the magnets 52 and 53 are adjusted and the maximum point of the density 58 of the magnetic flux, which is parallel to the direction of the arrow B shown in FIG. 6 and which is formed by the magnet 52 generating an N-pole line of magnetic force outside of the development sleeve 48, and the magnet 53 generating an S-pole line of magnetic force outside of the development sleeve 48 as shown in FIG. 4, faces the position of the control member 43. The density 58 of the magnetic flux is different from the line of magnetic force shown by the dotted line in FIG. 4.

Figure 7:
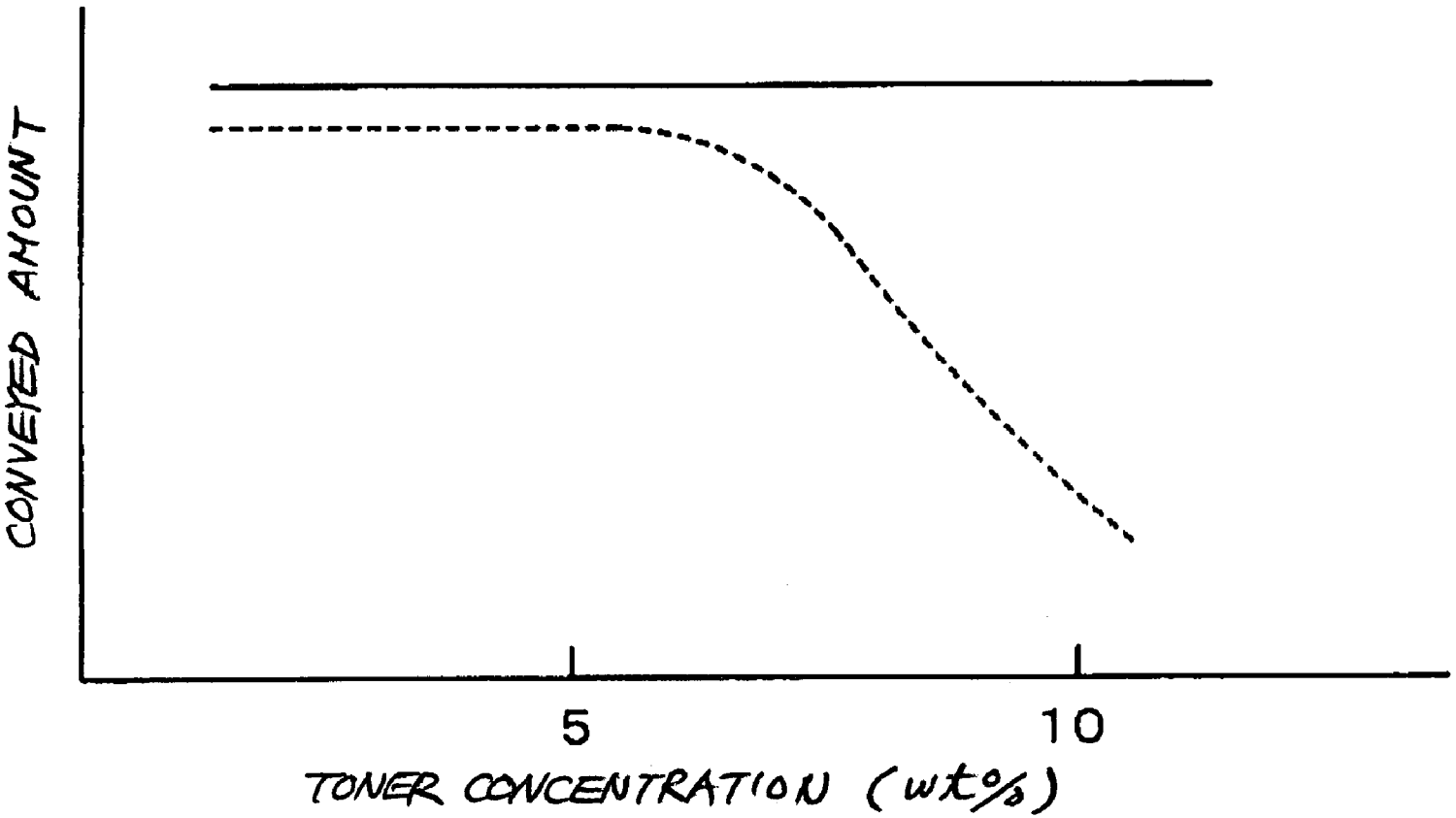
FIG. 7 is a correlation diagram comparing the relationship between the concentration of the toner in the developer and the amount of developer conveyed when the density of the magnetic flux formed by the magnetic field generating device is as shown in FIG. 6 and when it is not.

In FIG. 7, the solid line indicates the relationship between the toner concentration and the amount of developer conveyed in the configuration of the present embodiment when the maximum point of the magnetic flux parallel to the direction of the arrow B is at a position that corresponds to the position of the control member 43, and the dotted line indicates the relationship between the toner concentration and the amount of developer conveyed when the same maximum point is at a position that does not correspond to the position of the control member 43.

It is clear from FIG. 7 that when the toner concentration is 7 wt % or greater, in which case the amount of developer conveyed would normally be reduced due to a reduction in the fluidity of the developer and blocking of the developer in the wedge-shaped space between the control member 43 and the development sleeve 48, the developer is not blocked in the wedge-shaped space in the configuration of the present embodiment, and the amount of developer conveyed is not reduced.

Consequently, in the configuration of the present embodiment, wherein the maximum point of the magnetic flux that is parallel to the direction of the arrow B and that is formed by the magnet roller 49 is at a position corresponding to the position of the control member 43, image concentration irregularities are prevented, reductions in the amount of developer conveyed due to blocking of the developer are also prevented, and satisfactory development is performed.

Figure 8:
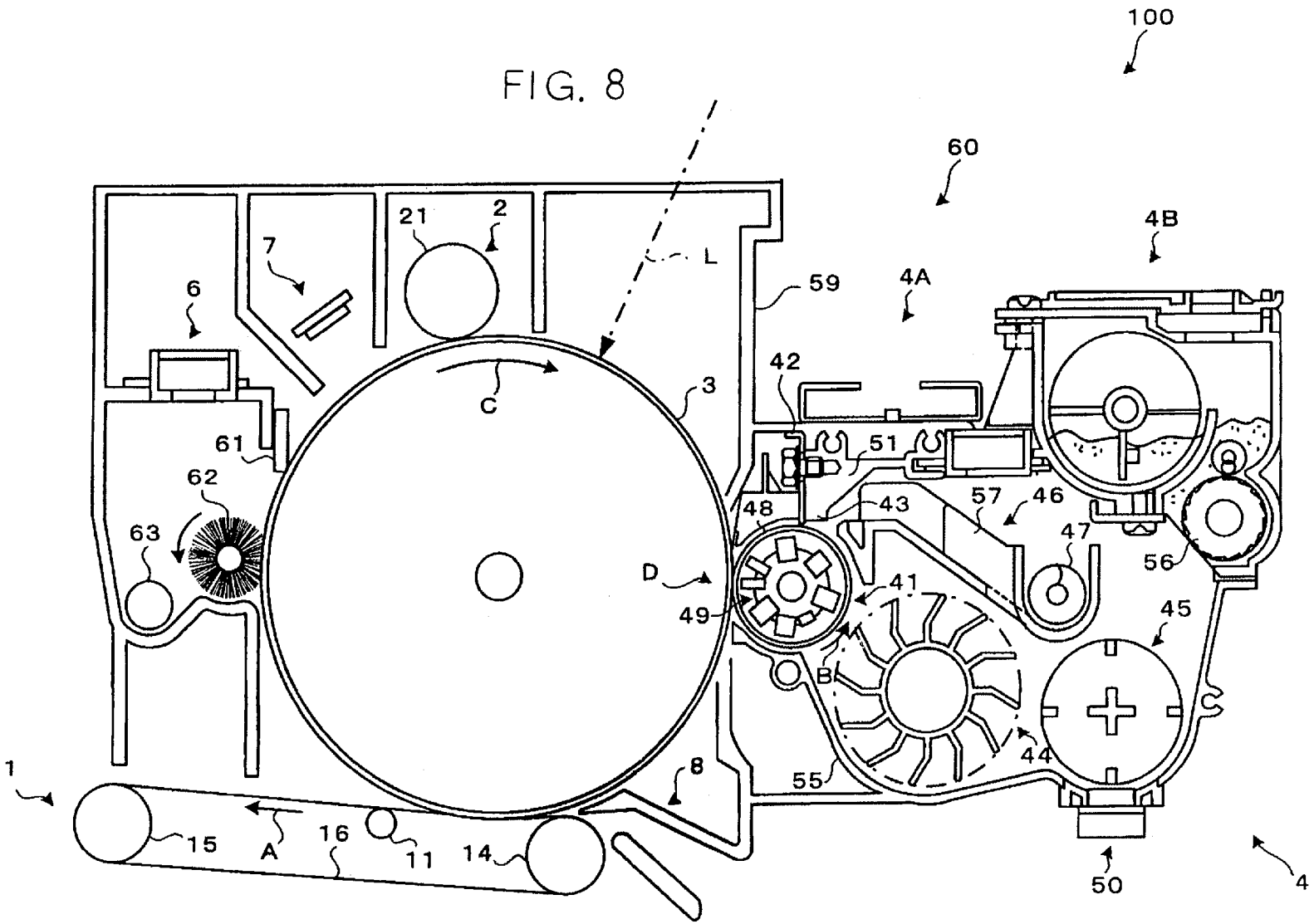
FIG. 8 is a front view showing the schematic configuration of an image-forming apparatus equipped with a development apparatus to which the present invention is applied, and a process cartridge provided with this development apparatus.

As shown in FIG. 8, a process cartridge 60 as a process unit is configured by integrating the photo conductor 3, the charging apparatus 2, the development apparatus 4, the cleaning apparatus 6, and the discharge apparatus 7 in a case 59 as a cartridge case, and the entire process cartridge 60 is preferably designed to be detachably mounted on the main body of the image-forming apparatus 100.

Thus, the apparatus can be maintained and replaced with greater ease by detachably mounting the photo conductor 3, the charging apparatus 2, the development apparatus 4, the cleaning apparatus 6, and the discharge apparatus 7 all together on the main body of the image-forming apparatus 100. For example, maintenance is simplified by removing only the necessary components to perform maintenance when no components need to be replaced. It is also effective, in terms of running cost reduction and the effective application of resources, to attach and detach the photo conductor 3, the charging apparatus 2, the development apparatus 4, the cleaning apparatus 6, and the discharge apparatus 7 as the process cartridge 60 to and from the main body of the image-forming apparatus 100. Specifically, although the durability for each configuration generally differs, such as the durability of the main body of the image-forming apparatus 100 differing from that of the process cartridge 60, the apparatus can be used over the course of the durability of the most durable component by setting the replacement cycle according to durability, and excellent results can therefore be obtained in terms of running cost reduction and the effective application of resources.

The process cartridge 60 integrally supports the photo conductor 3, the charging apparatus 2, the development apparatus 4, the cleaning apparatus 6, and the discharge apparatus 7, but the process cartridge may also be configured with other combinations in view of maintenance, running costs, and the like as described above. At least one of the photo conductor 3, the charging apparatus 2, or the cleaning apparatus 6 should be integrated with the development apparatus in order to configure a process cartridge that yields the effects of the development apparatus 4 to which the present invention is applied.

Because the image-forming apparatus 100 has the configuration described above, the operator uses a specific operation to switch on the power source of the image-forming apparatus 100 or to make the transition from standby mode to operating mode. When the operator subsequently uses a common operation to initiate image formation, the photo conductor 3 evenly charged in the charging step by the charging apparatus 2 is rotated in the direction of the arrow C to form a latent image in an exposure step with laser light L emitted according to data inputted from an external source and to undergo a development step wherein a toner image is formed by development due to the development apparatus 4, a transfer step of transferring the toner image onto transfer paper with the transfer and conveyance apparatus 1, and a cleaning step with the cleaning apparatus 6. The conductor is then initialized in a discharging step with the discharge apparatus 7, the charging step is repeated, and the next image formation process begins.

The toner image transferred to the transfer paper that has been conveyed from the paper feed tray in the transfer step is conveyed to a fixing apparatus by the transfer and conveyance apparatus 1, and is fixed onto the transfer paper by the fixing apparatus in a fixing step. The transfer paper to which the toner image is fixed is ejected out of the image-forming apparatus 100. In such an image formation step, the development step performed by the development apparatus 4 is performed satisfactorily without image concentration irregularities or the like as a result of the developer used in development being sufficiently supplied with an appropriate and uniform toner concentration.

An embodiment of a development apparatus, a process cartridge, and an image-forming apparatus to which the present invention is applied were described above, but the application of the present invention is not limited to the embodiment described above as long as no particular limits are imposed in the above description. For example, the developer-controlling member and the developer-residue controlling member may be configured integrally. The magnetic field generating device, whereby the maximum point of the density of the magnetic flux parallel to the direction in which the developer is conveyed by the developer support is found at the position of the developer-residue controlling member, may be disposed outside of the developer support and have a separate structure from the developer support.

The first electric potential setting device for providing the developer support and the developer-controlling member with the same electric potential, and the second electric potential setting device for providing the developer support and the developer-residue controlling member with the same electric potential need not be completely shared, and can also be configured to be at least partially shared as long as their functions can be fulfilled. The developer support may also be configured from only the development sleeve and not the entire development roller. The magnetic field generating means may also be configured from only a magnet that creates the maximum point of the magnetic flux density found at the position of the developer-residue controlling member, instead of the entire magnet roller.

As described above, the present invention has the following effects.

(1) The development apparatus of the present invention has a developer support that supports the developer on the surface, a developer-controlling member that controls the thickness of the developer on the developer support, a developer-residue controlling member disposed facing the developer support immediately upstream of the developer-controlling member in the direction in which the developer is conveyed by the developer support, and a space between the developer-residue controlling member and the developer support that decreases in size downstream in the conveyed direction. Therefore, a developer residue commonly formed by the developer-controlling member can be prevented from forming by the developer-residue controlling member, image concentration irregularities resulting from toner concentration irregularities can also be prevented from occurring, and satisfactory development can be performed.

(2) If a magnetic field generating device is provided whereby the maximum point of the density of the magnetic flux parallel to the direction in which the developer is conveyed by the developer support is disposed at the position of the developer-residue controlling member, a developer residue normally formed by to the developer-controlling member can be prevented from forming by the developer-residue controlling member, image concentration irregularities resulting from toner concentration irregularities can also be prevented from occurring, reductions in the amount of developer conveyed can be prevented by preventing the developer from being blocked in the space between the developer-residue controlling member and the developer support, and more satisfactory development can be performed.

(3) If the magnetic field generating device is disposed in the interior of the developer support, and the device generates a magnetic field that supports the developer on the surface of the developer support, then by utilizing a magnetic field generating device that is normally disposed in the interior of the developer support and that generates a magnetic field that supports the developer on the surface of the developer support, a developer residue normally formed by the developer-controlling member can be prevented from forming by the developer-residue controlling member, image concentration irregularities resulting from toner concentration irregularities can be prevented, reductions in the amount of developer conveyed can be prevented by preventing the developer from being blocked in the space between the developer-residue controlling member and the developer support, and satisfactory development can therefore be performed while preventing the apparatus from increasing in size and cost.

(4) If a first electric potential setting device for providing the developer support and the developer-controlling member with the same electric potential is included, a developer residue normally formed by the developer-controlling member can be prevented from forming by the developer-residue controlling member, image concentration irregularities resulting from toner concentration irregularities can be prevented, and the toner can be prevented from adhering to the developer support and the developer-controlling member, whereby reductions in the functions of the developer support and the developer-controlling member, fluctuations in the development bias, and reductions in the developer flow rate can be prevented, and more satisfactory development can be performed over time.

(5) If a second electric potential setting device for providing the developer support and the developer-residue controlling member with the same electric potential is included, a developer residue normally formed by the developer-controlling member can be prevented from forming by the developer-residue controlling member, image concentration irregularities resulting from toner concentration irregularities can be prevented, and the toner can be prevented from adhering to the developer support and the developer-controlling member, whereby reductions in the functions of the developer support and the developer-residue controlling member, fluctuations in the development bias, and reductions in the developer flow rate can be prevented, and more satisfactory development can be performed over time.

(6) If the first electric potential setting device and the second electric potential setting device are at least partially shared, then when the first electric potential setting device and the second electric potential setting device are provided simultaneously, their functions are maintained and their constituent components are shared, whereby a developer residue normally formed by the developer-controlling member can be prevented from forming by the developer-residue controlling member, image concentration irregularities resulting from toner concentration irregularities can be prevented, and satisfactory development can be performed while suppressing, for example, structural complications and increased costs.

(7) The process cartridge of the present invention includes the development apparatus described above and at least one component integrated with the development apparatus and selected from among an image support, an electrical charging device for charging the image support, and a cleaning device for cleaning the image support, and the process cartridge is also detachably mounted on the main body of the image-forming apparatus and therefore can contribute to satisfactory development and satisfactory image formation. Detachably mounting all the components together on the main body of the image-forming apparatus can make it easier to maintain and replace the apparatus, to reduce running costs, and to use resources in an effective manner.

(8) The image-forming apparatus of the present invention includes the development apparatus or the process cartridge described above; therefore, satisfactory development and satisfactory image formation can be performed.

Various modifications will become possible for those skilled in the art after receiving the teachings of the present disclosure without departing from the scope thereof.

What is claimed is:

1. A development apparatus comprising:

a developer support that supports developer on the surface;

a developer-controlling member that controls the thickness of the developer on the developer support;

a developer-residue controlling member disposed facing the developer support immediately upstream of the developer-controlling member in the direction in which the developer is conveyed by the developer support; and a space between the developer-residue controlling member and the developer support that decreases in size downstream in the direction in which the developer is conveyed, the space having a maximum width a and a minimum width b, wherein $2\ \text{mm} \leqq a \leqq 5\ \text{mm}$; and $0.5\ \text{mm} < b \leqq 1.8\ \text{mm}$.

2. The development apparatus according to claim 1, further comprising:

magnetic field generating means whereby the maximum point of the density of a magnetic flux parallel to the direction in which the developer is conveyed is disposed at the position of the developer-residue controlling member.

3. The development apparatus according to claim 2, wherein the magnetic field generating means is disposed in the interior of the developer support and is used to generate a magnetic field that supports the developer on the surface of the developer support.

4. The development apparatus according to claim 1, further comprising:

first electric potential setting means for providing the developer support and the developer-controlling member with the same electric potential.

5. The development apparatus according to claim 4, further comprising:

second electric potential setting means for providing the developer support and the developer-residue controlling member with the same electric potential.

6. The development apparatus according to claim 5, wherein the first electric potential setting means and the second electric potential setting means are at least partially shared.

7. A process cartridge detachably mounted on the main body of an image-forming apparatus, comprising:

a development apparatus; and at least one component integrated with the development apparatus and selected from among an image support, electrical charging means for charging the image support, and cleaning means for cleaning the image support, wherein the development apparatus comprises: a developer support that supports developer on the surface; a developer-controlling member that controls the thickness of the developer on the developer support; a developer-residue controlling member disposed facing the developer support immediately upstream of the developer-controlling member in the direction in which the developer is conveyed by the developer support; and a space between the developer-residue controlling member and the developer support that decreases in size downstream in the direction in which the developer is conveyed, the space having a maximum width a and a minimum width b, wherein $2\ \text{mm} \leqq a \leqq 5\ \text{mm}$; and $0.5\ \text{mm} < b \leqq 1.8\ \text{mm}$.

8. An image-forming apparatus comprising, a development apparatus, including: a developer support that supports developer on the surface;

a developer-controlling member that controls the thickness of the developer on the developer support;

a developer-residue controlling member disposed facing the developer support immediately upstream of the developer-controlling member in the direction in which the developer is conveyed by the developer support; and a space between the developer-residue controlling member and the developer support that decreases in size downstream in the direction in which the developer is conveyed, the space having a maximum width a and a minimum width b, wherein 2 mm≦a≦5 mm; and 0.5 mm<b≦1.8 mm.

9. An image-forming apparatus comprising, a process cartridge detachably mounted on the main body of an image-forming apparatus including:

a development apparatus; and at least one component integrated with the development apparatus and selected from among an image support, electrical charging means for charging the image support, and cleaning means for cleaning the image support, and wherein the development apparatus includes:

a developer support that supports developer on the surface;

a developer-controlling member that controls the thickness of the developer on the developer support;

a developer-residue controlling member disposed facing the developer support immediately upstream of the developer-controlling member in the direction in which the developer is conveyed by the developer support; and a space between the developer-residue controlling member and the developer support that decreases in size downstream in the direction in which the developer is conveyed, the space having a maximum width a and a minimum width b, wherein 2 mm≦a≦5 mm; and 0.5 mm<b≦1.8 mm.

* * * * *